US006383100B2

(12) United States Patent
Pitsenberger et al.

(10) Patent No.: US 6,383,100 B2
(45) Date of Patent: May 7, 2002

(54) BAT WITH VARYING CIRCUMFERENTIAL WALL THICKNESS

(75) Inventors: Danial S. Pitsenberger; Danny W. Maxey, both of Tullahoma, TN (US)

(73) Assignee: Worth, Inc., Tullahoma, TN (US)

( * ) Notice: Subject to any disclaimer, the term of this patent is extended or adjusted under 35 U.S.C. 154(b) by 0 days.

(21) Appl. No.: 09/853,095

(22) Filed: May 10, 2001

Related U.S. Application Data

(63) Continuation of application No. 09/015,651, filed on Jan. 29, 1998, now abandoned.

(51) Int. Cl.[7] ..... A63B 59/06
(52) U.S. Cl. ..... 473/566; 473/567
(58) Field of Search ..... 473/564, 566, 473/567, 457, 519, 520

(56) References Cited

U.S. PATENT DOCUMENTS 2,340,156 A 1/1944 Taylor et al.
3,697,069 A 10/1972 Merola
4,025,377 A 5/1977 Tanikawa
4,600,193 A 7/1986 Merritt
5,094,453 A 3/1992 Douglas et al.
5,364,095 A 11/1994 Easton et al.
5,415,398 A 5/1995 Eggiman
5,511,777 A 4/1996 McNeely
5,961,405 A 10/1999 MacKay, Jr.

*Primary Examiner*—Mark S. Graham
(74) *Attorney, Agent, or Firm*—Waddey & Patterson; Lucian Wayne Beavers

(57) ABSTRACT

A bat having a non-uniform circumferential wall thickness. The bat comprises a tubular body having a handle portion, a tapered mid-section and a barrel or impact portion. In one embodiment, the outer diameter of the bat is constant, while the inner diameter varies between a maximum diameter and a minimum diameter to create alternating points of maximum wall thickness and minimum wall thickness. In an alternate embodiment, the inner diameter of the bat remains constant, while the outer diameter varies to create alternating points of maximum and minimum wall thickness. The distance between points of maximum and minimum wall thickness is such that there are at least two points of maximum wall thickness under the area of the bat that is contacted by a ball upon impact.

10 Claims, 4 Drawing Sheets

BAT WITH VARYING CIRCUMFERENTIAL WALL THICKNESS

This application is a continuation of application Ser. No. 09/015,651 of Dan S. Pitsenberger, entitled "Bat With Varying Circumferential Wall Thickness" filed Jan. 29, 1998 now abandoned.

Be it known that we, Dan S. Pitsenberger, a citizen of the U.S. residing at 108 Safley Court, Tullahoma, Tenn. 37388, and Danny W. Maxey, a citizen of the U.S. residing at 1195 Turkey Creek Road, Tullahoma, Tenn. 37338, have invented a new and useful "Bat With Varying Circumferential Wall Thickness".

BACKGROUND OF THE INVENTION

The present invention relates generally to softball and baseball bats, and more particularly to such bats having a varying circumferential wall thickness.

In an effort to continually improve bats, manufacturers seek out new materials and designs. Most top of the line bats utilize the highest tensile and yield-strength alloys available, such as the 7000 series hard alloys, titanium and composites, all of which are readily available to manufacturers. Thus, in an effort to differentiate products constructed of the same materials, manufacturers and engineers focus on the development of features that will enhance the performance and durability of the bat. To this end, there have been several attempts to design bats which include structural features to maximize performance and/or reinforce the interior of the tube for increased durability.

One such attempt was disclosed in U.S. Pat. No. 5,364,095, assigned to Easton, Inc., which is incorporated by reference as if fully set forth herein, is directed to a tubular metal ball bat internally reinforced with fiber composite. The bat comprises a hollow metal tube including a metal sleeve compressively engaged with the interior of the tube. The sleeve is formed of carbon fibers in an epoxy matrix.

U.S. Pat. No. 5,511,777, issued to McNeely, which is incorporated by reference as if fully set forth herein, is directed to a ball bat with a rebound core. The McNeely bat comprises a hollow tube having a tube wall including a barrel portion, a tapered portion and a handle portion. The bat includes an inner damper that is covered by a resilient attenuator sleeve. The inner damper is inserted into the hollow tube such that the resilient attenuator sleeve is compressed between the inner damper and the tube wall. A cap covers the open top of the tube and a knob is installed to the open bottom.

U.S. Pat. No. 5,415,398, issued to Eggiman, which is incorporated by reference as if fully set forth herein, is directed to a softball bat having a tubular insert. A tubular aluminum bat frame is provided with a large diameter impact portion, an intermediate tapering portion, and a small-diameter handle portion. A tubular insert is suspended within the impact portion by interference fits at each insert end. A gap exists along the length of the suspended insert separating the insert from the interior of the impact portion. The gap is filled with grease to facilitate relative movement between the insert and the tubular frame when a ball is batted.

All of the aforementioned designs attempt to maximize the wall flexibility, or "trampoline effect", and/or reinforce the interior walls for durability. Furthermore, all of these designs utilize an interior reinforcing mechanism with an exterior tube of uniform wall thickness.

However, an important consideration in bat design is overall bat weight. Thus, it is desirable to design a bat of minimal weight, which is generally achieved by using a lightweight material and by minimizing the wall thickness of the bat, without compromising the structural integrity of the bat. In order to maintain the structural integrity of the bat upon impact, the wall thickness of the impact portion of the bat must be a certain thickness, which is based on the strength of the bat material. Previous bat designs have attempted to minimize bat weight by varying the wall thickness along the length of the bat. What is needed, then, is a bat that minimizes bat weight by varying the wall thickness circumferentially.

SUMMARY OF THE INVENTION

The bat of the present invention comprises a tubular body having a handle portion, a tapered mid-section and a barrel or impact portion. In order to increase the strength of the bat and yet optimize wall flex for maximum "trampoline effect", the wall thickness of the bat varies about the circumference. In one embodiment, the outer diameter of the bat is constant, while the inner diameter varies between a maximum diameter and a minimum diameter to create alternating points of maximum wall thickness and minimum wall thickness. In an alternate embodiment, the inner diameter of the bat remains constant, while the outer diameter varies to create alternating points of maximum and minimum wall thickness. The distance between points of maximum and minimum wall thickness is such that there are at least two points of maximum wall thickness under the impact area, i.e. the area of the bat that is contacted by a ball upon impact. Further, the minimum wall thickness is selected so that the average wall thickness under the area of impact does not fall below the thickness required to resist denting based on the strength of the particular material from which the bat is constructed.

The bat may be constructed from any suitable material, such as aluminum, titanium, composites and the like.

A first object of this invention is to provide a metal ball bat that is lightweight yet strong enough to resist ball impact damage.

It is an object of the present invention to provide a bat having a handle portion, a mid-section and a barrel portion with a wall thickness that varies circumferentially.

It is another object of the present invention to provide a bat having a variable circumferential wall thickness wherein there are at least two points of maximum wall thickness under any given impact area.

It is another object of the present invention to provide a bat having a variable circumferential wall thickness wherein the average wall thickness under a given impact area is no less than the minimum thickness required to resist denting for the particular bat material.

These and other objects, features and advantages shall become apparent after consideration of the description and drawings set forth herein. All such objects, features and advantages are contemplated to be within the scope of the present invention even though not specifically set forth herein.

DESCRIPTION OF THE PREFERRED EMBODIMENT

Figure 1:
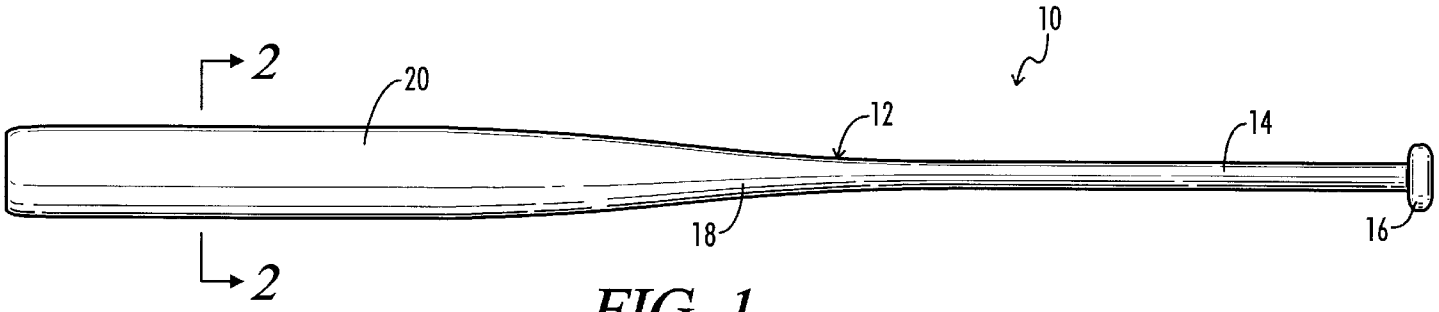
FIG. 1 is a side view of a bat having a varying circumferential wall thickness in accordance with the present invention.

An embodiment of the present invention is designated generally by the reference numeral 10 in FIG. 1. Bat 10 comprises an elongated, tubular body 12 having a handle portion 14, which terminates in a knob 16, a tapered mid-section 18, and a barrel or impact portion 20.

Figure 2B:
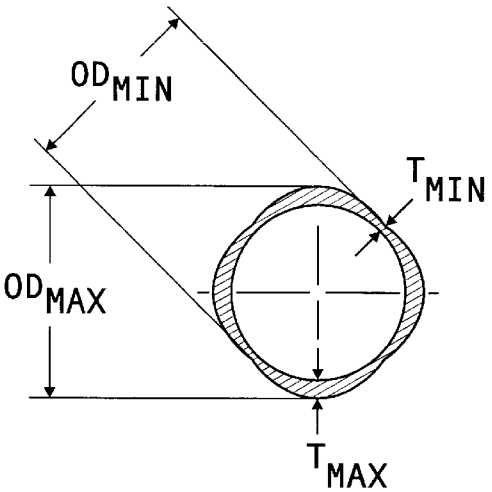
FIG. 2B is a cross-sectional view taken along line 2—2 of FIG. 1 showing the manner in which the outer diameter varies about the circumference of the bat of the present invention, including four points of maximum wall thickness and four points of minimum wall thickness offset ninety degrees from the points of maximum wall thickness.
Figure 2A:
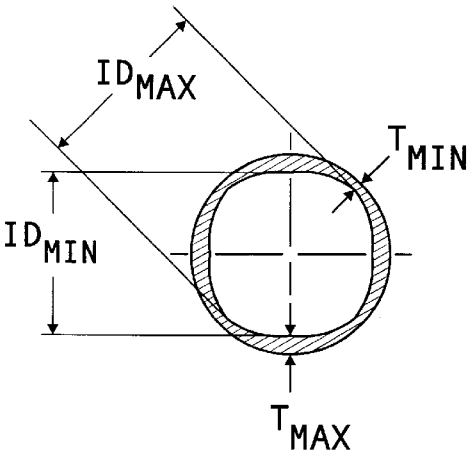
FIG. 2A is a cross-sectional view taken along line 2—2 of FIG. 1 showing the manner in which the inner diameter varies about the circumference of the bat of the present invention, including four points of maximum wall thickness equally spaced between four points of minimum wall thickness.

In order to maximize strength and optimize wall flexibility, the bat 10 of the present invention is formed from a single-wall tube having a non-uniform wall thickness. In the preferred embodiment, the wall thickness of the bat 10 varies circumferentially over the length of the impact portion 20. In one embodiment, the geometry of the outer surface of the tubular body 12 is circular and, therefore, the outer diameter of the bat 10 is constant (see FIG. 2C). However, the geometry of the inner surface of the tubular body 12 is non-uniform, therefore, the inner diameter varies between a maximum diameter $ID_{MAX}$ and a minimum diameter $ID_{MIN}$ to create alternating points of maximum wall thickness $T_{MAX}$ and minimum wall thickness $T_{MIN}$ (see FIG. 2A).

Figure 2D:
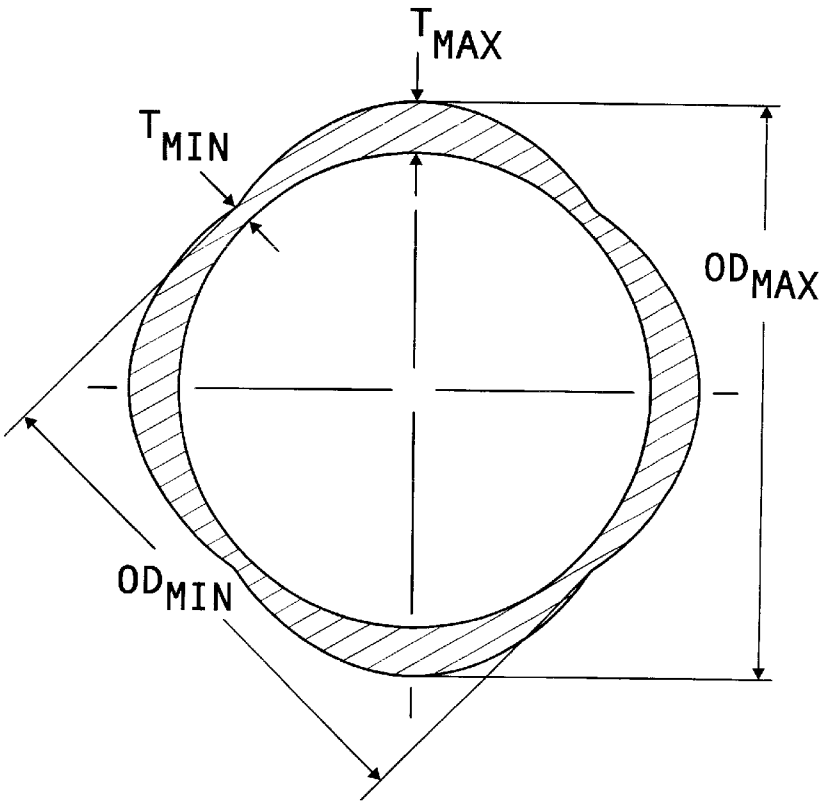
FIG. 2D is an enlarged cross-sectional view showing the variation in wall thickness along the outer surface of the bat between points of maximum wall thickness and points of minimum wall thickness.

In an alternate embodiment, the geometry of the inner surface is circular and, therefore, the inner diameter of the bat 10 is constant (see FIG. 2D). Accordingly, the geometry of the outer surface of the tubular body 12 is non-uniform, and the outer diameter varies between a maximum diameter $OD_{MAX}$ and a minimum diameter $OD_{MIN}$ to create alternating points of maximum wall thickness $T_{MAX}$ and minimum wall thickness $T_{MIN}$ (see FIG. 2B).

The wall thickness transitions gradually between the points of maximum wall thickness $T_{MAX}$ and the points of minimum wall thickness $T_{MIN}$ so that there are no abrupt changes in wall thickness about the circumference of the bat 10.

Figure 2C:
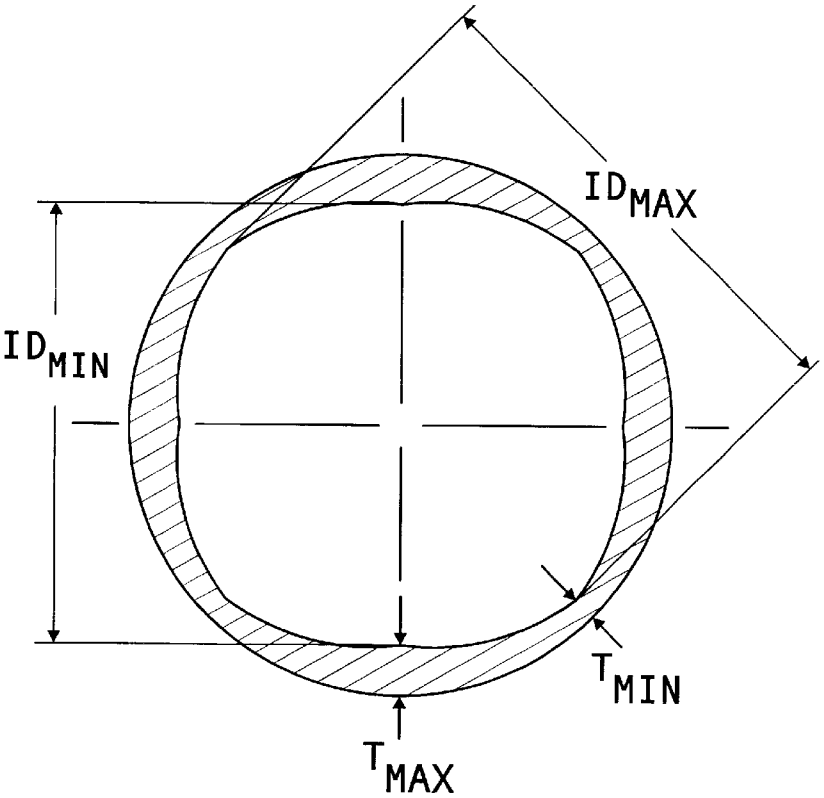
FIG. 2C is an enlarged cross-sectional view showing the variation in wall thickness along the inner surface of the bat between points of maximum wall thickness and points of minimum wall thickness.

As seen in FIGS. 2C and 2D, when viewed in cross section, these gradual wall thickness transitions result in surfaces extending only at very shallow angles to a tangent to the circumference of the bat. This is contrasted to various prior art bats which have essentially ribbed cross sectional structures.

The cross-sectional profile of the inner (or outer) surface of the bat 10 of the present invention resembles a "cloverleaf" in that it includes four points of maximum wall thickness $T_{MAX}$ alternately disposed between four areas of minimum wall thickness $T_{MIN}$. Other configurations with greater than or less than four points of maximum and minimum wall thickness are also contemplated to be within the scope of the present invention. However, the bat 10 of the present invention is configured so that a fixed distance exists between points of minimum wall thickness $T_{MIN}$ and points of maximum wall thickness $T_{MAX}$.

When a baseball or softball is struck with a bat, a portion of the ball directly engages an area on the impact portion of the bat and defines what is commonly referred to as the "impact area". The typical impact area of a softball against a softball bat ranges from two (2) to three (3) square inches. Accordingly, the bat 10 of the present invention is preferably configured so that at least two points of maximum wall thickness are contained within any given impact area of the bat 10.

The wall thickness of the bat is determined according to the strength of the bat material and the force of impact. Any force that exceeds the strain rate of the material will cause the material to plastically deform, resulting in a dented bat. In the bat 10 of the present invention, the minimum wall thickness is selected so that the average wall thickness under any given area of impact on the bat 10 is not less than the thickness required to resist denting.

Based on the cloverleaf design described hereinabove, it has been determined that for a bat constructed of a 7055 alloy, a maximum wall thickness of 0.080 inches and a minimum wall thickness of 0.068 inches would achieve the desired durability and performance characteristics.

Figure 5:
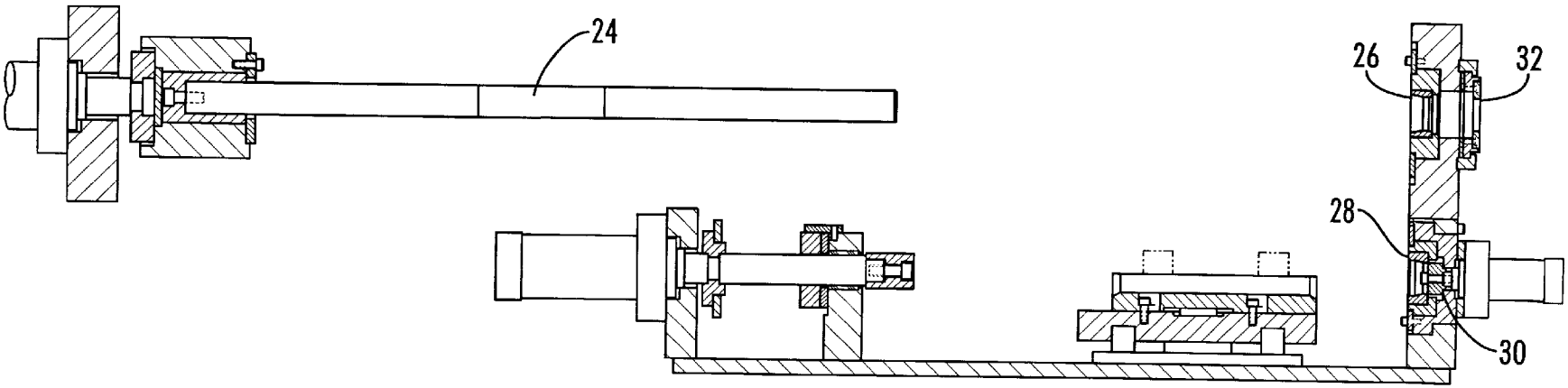
FIG. 5 is a schematic showing the method of the present invention.

With reference to FIG. 5, the wall thickness of the bat 10 of the present invention is manipulated using a push pointing method of processing to achieve the desired inner surface geometry. To control the wall thickness, a tube 22 is formed over a mandrel 24 that is greater in length than the tube. To form a bat 10 having a circular outer diameter and variable inner diameter, the tube 22 is positioned on a mandrel 24 having an outer surface geometry that is configured to create the desired inner surface geometry of the tube. Thus, the outer surface of the mandrel 24 is configured to form circumferential points of maximum wall thickness $T_{MAX}$ and circumferential points of minimum wall thickness $T_{MIN}$ along the inner surface of the tube during processing.

To form a bat 10 having a circular inner diameter and variable outer diameter, the tube 22 is positioned on a mandrel 24 having a circular cross section. The tube 22 is then processed through a reducing die 26 to form the desired outer surface geometry and, thus, create a tube 22 having a non-uniform wall thickness.

Figure 3:
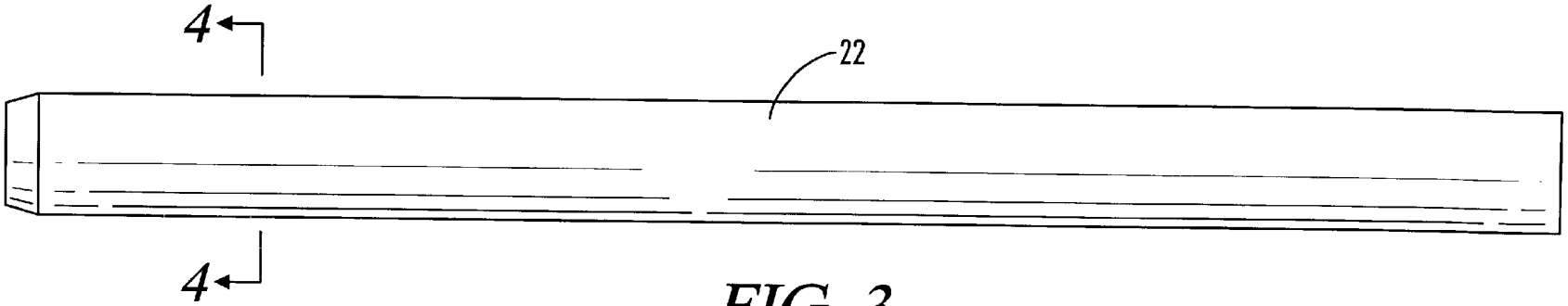
FIG. 3 is side view of the tube used to form the bat of the present invention.
Figure 4:
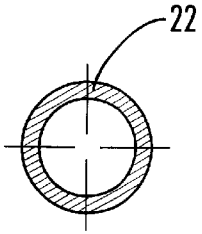
FIG. 4 is a cross-sectional view taken along line 4—4 of FIG. 3 showing the tube having a uniform wall thickness prior to processing according to the method of the present invention.

The method of the present invention includes providing a single wall tube 22 having open ends and a relatively uniform wall thickness T (see FIG. 4). At the nosing station, the tube 22 is processed through a nosing die 28, which tapers an end of the tube 22 inwardly as shown in FIG. 3. A nosing stripper 30 is provided to remove the tube 22 from the nosing die 28. The tube 22 then proceeds to a reducing station where it is processed through the reducing die 26 to create the desired wall thickness geometry. A stripper 32 is provided to remove the processed tube 22 from the reducing die 26.

Thus, although there have been described particular embodiments of the present invention of a new and useful bat with an exterior shell, it is not intended that such references be construed as limitations upon the scope of this invention except as set forth in the following claims.

What I claim is:

1. A tubular bat wherein an impact portion thereof has a non-uniform circumferential wall thickness including four and only four points of maximum wall thickness alternately disposed between points of minimum wall thickness, the wall thickness continuously varying over a majority of the circumference of the impact portion of the bat.

2. The bat of claim 1, wherein the maximum wall thickness is at least 0.080 inches, and the minimum wall thickness is at least 0.068 inches.

3. The bat of claim 1, wherein at least two circumferential points of maximum wall thickness are contained within an impact area of predetermined size.

4. The bat of claim 1, wherein an average wall thickness within a given impact area is at least equal to the minimum wall thickness required to resist denting for a given material from which the bat is constructed.

5. The bat of claim 1, wherein the circumferential points of maximum wall thickness are equally spaced about the circumference of the bat 90° apart.

6. A bat having a handle portion, a midsection and an impact portion, comprising:

a cylindrical tubular body having a wall thickness, and wherein the wall thickness of at least a part of the impact portion of the bat gradually and continuously varies alternately a plurality of times between a maximum and a minimum to create a non-uniform circumferential wall thickness.

7. The bat of claim 6, wherein adjacent points of maximum wall thickness are spaced 90° apart.

8. The bat of claim 7, wherein an outside circumference diameter of the bat is circular and an inside of the bat is irregular to create the non-uniform circumferential wall thickness.

9. The bat of claim 7, wherein an inside diameter of the bat is circular and an outside circumference of the bat is irregular to create the non-uniform circumferential wall thickness.

10. The bat of claim 6, wherein the non-uniform circumferential wall thickness extends along substantially the entire length of the impact portion of the bat.

* * * * *